US005617791A

United States Patent [19]

Fürbass

[11] Patent Number: 5,617,791

[45] Date of Patent: Apr. 8, 1997

[54] SHEET-GUIDING DRUM, IN PARTICULAR A DELIVERY DRUM, OF A SHEET-FED ROTARY PRINTING PRESS

[75] Inventor: Jürgen Fürbass, Nussloch, Germany

[73] Assignee: Heidelberger Druckmaschinen AG, Heidelberg, Germany

[21] Appl. No.: 643,639

[22] Filed: May 6, 1996

[30] Foreign Application Priority Data

May 4, 1995 [DE] Germany ..... 195 16 066.5

[51] Int. Cl.[6] ..... B41F 22/00

[52] U.S. Cl. ..... 101/420; 101/232; 271/275

[58] Field of Search ..... 101/418, 420, 101/232; 226/190, 191, 194; 271/275

[56] References Cited

U.S. PATENT DOCUMENTS

| | | | |
|---|---|---|---|
| 3,780,925 | 12/1973 | Ternes | 101/420 |
| 4,060,238 | 11/1977 | Simeth | 101/420 X |
| 4,846,062 | 7/1989 | Difflipp et al. | 101/420 X |
| 4,977,828 | 12/1990 | Douglas | 101/420 X |
| 5,046,421 | 9/1991 | DeMoore | 101/420 |
| 5,115,740 | 5/1992 | Emrich et al. | 101/420 |
| 5,244,138 | 9/1993 | Blanding et al. | 226/190 X |
| 5,245,358 | 9/1993 | Reeves et al. | 271/275 X |
| 5,413,044 | 5/1995 | Wu et al. | 101/420 |

*Primary Examiner*—Christopher A. Bennett
*Attorney, Agent, or Firm*—Herbert L. Lerner; Laurence A. Greenberg

[57] ABSTRACT

Sheet-guiding drum of a sheet-fed rotary printing press having a drum shaft with support flanges mounted thereon for supporting paper carrier rods, respectively, having a longitudinal axis extending transversely to sheet travel direction on the drum, includes at least one additional support formed as a segment-shaped member and mounted on the drum shaft between a respective pair of the support flanges in a sheet-guiding region of the drum, said segment-shaped member having snap holders disposed at spaced intervals on the circumference thereof, said snap holders being formed of radially projecting, elastically deformable retaining lugs surrounding in pairs, over more than 180°, a holder bar of a paper carrier rod.

5 Claims, 1 Drawing Sheet

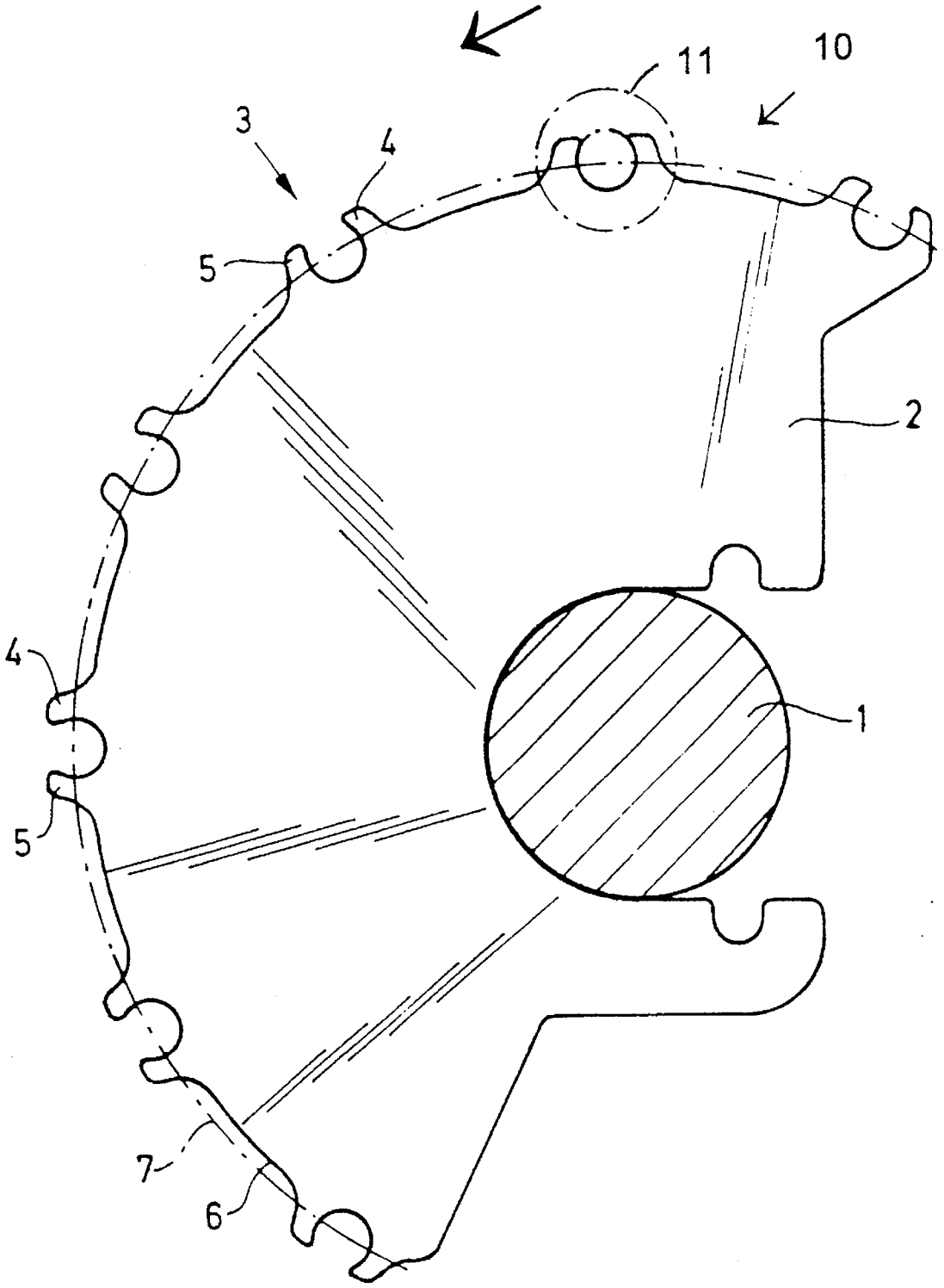
11
10
3
4
5
2
4
1
5
7
6

SHEET-GUIDING DRUM, IN PARTICULAR A DELIVERY DRUM, OF A SHEET-FED ROTARY PRINTING PRESS

BACKGROUND OF THE INVENTION

Field of the Invention

The invention relates to a sheet-guiding drum of a sheet-fed rotary printing press having a drum shaft with support flanges mounted thereon for supporting paper carrier rods, respectively, having a longitudinal axis extending transversely to sheet travel direction on the drum.

When freshly printed sheets are transferred from an impression cylinder of a rotary printing press to a drum for further transporting the sheets, particularly to a delivery drum, markings occur from the equipment which supports the sheet on the drum and which is made up of support flanges revolving in planes parallel to the sheet travel direction and also of paper carrier rods, usually of round cross section, disposed on the circumference of the drum at spaced intervals transversely to the sheet travel, the paper carrier rods being inserted through bores formed in the support flanges, so that the sheet guided on the drum comes into contact with the circumferential surface of the support flanges and also with the paper carrier rods extending transversely to the sheet travel direction. For the paper carrier rods to have the smallest, i.e., thinnest, possible cross sections a close spacing of the support flanges is required in order to prevent sagging of the paper carrier rods. However, the greater the number of support flanges, the more undesired markings occur on the yet freshly printed sheet.

SUMMARY OF THE INVENTION

It is accordingly an object of the invention to provide a sheet-guiding drum, in particular a delivery drum, of a sheet-fed rotary printing press with supports for the paper carrier rods in the sheet-carrying region of the drum, in a manner that the risk of marking upon contact with a freshly printed sheet is reduced considerably.

With the foregoing and other objects in view, there is provided, in accordance with the invention, a sheet-guiding drum of a sheet-fed rotary printing press having a drum shaft with support flanges mounted thereon for supporting paper carrier rods, respectively, having a longitudinal axis extending transversely to sheet travel direction on the drum, comprising at least one additional support formed as a segment-shaped member and mounted on the drum shaft between a respective pair of the support flanges in a sheet-guiding region of the drum, the segment-shaped member having snap holders disposed at spaced intervals on the circumference thereof, the snap holders being formed of radially projecting, elastically deformable retaining lugs surrounding in pairs, over more than 180°, a holder bar of a paper carrier rod.

In accordance with another feature of the invention, the snap holders formed by the retaining lugs have imaginary construction centers disposed on an imaginary base circle which is located radially outside the circumference of the segment-shaped member.

In accordance with a further feature of the invention, the segment-shaped member has a snap connection for securing the segment-shaped member on the drum shaft.

In accordance with an added feature of the invention, the snap holders are formed of plastic material.

In accordance with a concomitant feature of the invention, the snap holders are integral parts of the segment-shaped member, and the segment-shaped member is formed of plastic material.

Lightweight segments formed of plastic material and having the foregoing features in accordance with the invention enable a punctiform or linear support of the freshly printed sheet on the paper carrier rods and their holders or supports, so that the danger of a possible marking of the freshly printed sheet is considerably reduced. To prevent the paper carrier rods from sagging, the support equipment therefore can be supplemented by segment-shaped members formed of plastic material, in accordance with the invention, at arbitrary and optionally close distances from one another. The plastic-material segment-shaped members can be built-in retroactively, i.e., retrofitted, or removed again as needed, without tools. All the fastenings are effected by elastic deformation of material through the use of snap connections. An important feature of the invention is that the base circle defined by the centers of construction of the snap holders formed by the supports or holders is located radially outside the circumference of the segment-shaped member, so that the possibly radially inwardly sagging sheets on the drum do not immediately come into contact with the circumference of the support flanges of the drum.

Other features which are considered as characteristic for the invention are set forth in the appended claims.

Although the invention is illustrated and described herein as embodied in a sheet-guiding drum, in particular a delivery drum, of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific enmbodiments when read in connection with the single FIGURE of the drawing.

BRIEF DESCRIPTION OF THE DRAWING

The single FIGURE is a fragmentary, cross-sectional view of an exemplary embodiment of the sheet-guiding drum according to the invention showing, in a side elevational view, a segment formed of plastic material.

DESCRIPTION OF THE PREFERRED EMBODIMENTS

Referring now to the drawing, there is shown fragmentarily a sheet-guiding drum 10, such as a delivery drum, for example, having paper carrier rods 11 longitudinally extending, transversely to a sheet travel direction represented by the associated curved arrow, in non-illustrated support flanges on a drum shaft 1. At least in the sheet-carrying region of the drum 10, at least at one location between two such support flanges, the paper carrier rods 11 are provided with additional support on the drum shaft 1 by means of a plastic segment 2 which, in the case of the illustrated exemplary embodiment, extends circumferentially over a 180° sector. Snap holders 3 formed of radially projecting, elastically deformable retaining lugs 4 and 5 are formed on the circumference of the plastic segment 2, and are disposed in respective pairs for enclosing a holder bar of the paper carrier rods 11 over slightly more than 180°. The fastening of the holder bar in a snap holder 3 thus occurs due to elastic deformation of the retaining lugs 4 and 5, so that installation and removal can be effected without tools and without exerting any special force. The retaining lugs 4 and 5 protrude radially beyond the circumference 6 of the plastic segment 2, so that the base circle 7 of the construction centers of the snap holders 3 formed by the retaining lugs 4 and 5 is located radially outside the segment circumference 6. The fastening of a plastic segment 2 on the drum shaft 1 can be performed in a conventional manner, for example, by providing the plastic segment 2 with a hublike attachment that can be secured by screws or the like to the drum shaft 1. As an alternative, the invention also contemplates the possibility that the plastic segment 2 can be fastened to the drum shaft 1 with a snap connection. A snap connection suitable for this purpose surrounds the drum shaft 1 over more than 180° and enables the plastic segment 2 to be slipped onto the drum shaft 1 with elastic deformation of the plastic material of which the plastic segment 2 is formed. In the interest of having the least possible weight, the plastic segment 2 is formed as thin as possible.

I claim:

1. Sheet-guiding drum of a sheet-fed rotary printing press having a drum shaft with support flanges mounted thereon for supporting paper carrier rods, respectively, having a longitudinal axis extending transversely to sheet travel direction on the drum, comprising at least one additional support formed as a segment-shaped member and mounted on the drum shaft between a respective pair of the support flanges in a sheet-guiding region of the drum, said segment-shaped member having snap holders disposed at spaced intervals on the circumference thereof, said snap holders being formed of radially projecting, elastically deformable retaining lugs surrounding in pairs, over more than 180°, a holder bar of a paper carrier rod.

2. Drum according to claim 1, wherein said snap holders formed by said retaining lugs have imaginary construction centers disposed on an imaginary base circle which is located radially outside said circumference of said segment-shaped member.

3. Drum according to claim 1, wherein said segment-shaped member has a snap connection for securing said segment-shaped member on the drum shaft.

4. Drum according to claim 1, wherein said snap holders are formed of plastic material.

5. Drum according to claim 1, wherein said snap holders are integral parts of said segment-shaped member, and said segment-shaped member is formed of plastic material.

* * * * *